US011641942B1

(12) United States Patent
Rockley

(10) Patent No.: US 11,641,942 B1
(45) Date of Patent: May 9, 2023

(54) STORAGE RACK SYSTEM

(71) Applicant: Ken Rockley Pty Ltd., Broome (AU)

(72) Inventor: Kenneth John Rockley, Broome (AU)

( * ) Notice: Subject to any disclaimer, the term of this patent is extended or adjusted under 35 U.S.C. 154(b) by 0 days.

(21) Appl. No.: 17/667,040

(22) Filed: Feb. 8, 2022

(51) Int. Cl.

| | |
|---|---|
| ***A47B 96/06*** | (2006.01) |
| ***A47B 57/34*** | (2006.01) |
| *A47B 57/06* | (2006.01) |
| *A47B 57/30* | (2006.01) |
| *A47B 57/46* | (2006.01) |

(52) U.S. Cl.
CPC ..... *A47B 96/061* (2013.01); *A47B 57/34* (2013.01); *A47B 57/06* (2013.01); *A47B 57/30* (2013.01); *A47B 57/46* (2013.01); *A47B 96/06* (2013.01)

(58) Field of Classification Search
CPC ..... A47B 57/34; A47B 96/061; A47B 57/56; A47B 57/46; A47B 57/42; A47B 57/30; A47B 57/06; A47B 96/068; A47B 96/06
See application file for complete search history.

(56) References Cited

U.S. PATENT DOCUMENTS

| | | | | |
|---|---|---|---|---|
| 2,696,139 A | 12/1954 | Attwood | | |
| 4,784,552 A | 11/1988 | Rebentisch | | |
| 5,775,655 A * | 7/1998 | Schmeets | A47B 5/00 | 108/115 |
| 7,258,197 B1 * | 8/2007 | Wicks | E04G 5/06 | 248/246 |
| 7,748,195 B2 * | 7/2010 | Keith | E04G 5/046 | 182/87 |
| 9,038,344 B2 * | 5/2015 | Mayer | F21V 33/006 | 52/39 |
| 9,103,365 B2 * | 8/2015 | Whipple | F16B 37/045 | |
| 2006/0243524 A1 * | 11/2006 | Jarrell | E04G 5/06 | 182/150 |
| 2014/0027589 A1 * | 1/2014 | Durgin | A47B 96/07 | 248/250 |

* cited by examiner

*Primary Examiner* — Devin K Barnett
(74) *Attorney, Agent, or Firm* — Eric Karich; Karich & Associates

(57) ABSTRACT

A storage system includes a shelf bracket that has an elongate rigid mounting structure. The shelf bracket includes a top arm extending outwardly from, and orthogonal to, the elongate rigid mounting structure. The shelf bracket further includes a bottom arm extending outwardly from the elongate rigid mounting structure, at an angle of between 5-60 degrees. The bottom arm is in the form of a strut channel that includes a U-shaped cross section that includes a back wall, two opposed side walls extending downwardly from the back wall, each of the opposed side walls extending to an inwardly extending portion, which extends to an edge.

4 Claims, 4 Drawing Sheets

STORAGE RACK SYSTEM

BACKGROUND OF THE INVENTION

Field of the Invention

This invention relates to storage rack systems, and more particularly to a rack system that has customizable shelf brackets to removably mount items.

Description of Related Art

The prior art teaches multiple forms of mounting structures that include a channeled structure, a locking nut, and a bolt for locking objects on the channeled structure, commonly referred to as a strut channel.

Rebentisch (U.S. Pat. No. 4,784,552), Assigned to Unistrut International Corp., teaches a special nut for affixing parts to a channeled structural member. The nut has an improved positioning means protruding from the top surface of the nut for properly positioning the nut in the channel member.

Attwood (U.S. Pat. No. 2,696,139) teaches a special nut for fixing parts to structures of channeled metal, consisting of a relatively narrow rectangular metal piece having a centrally located tapped opening and having two diagonally opposite corners removed, said nut being provided on one face with a spring arranged normal to the nut face and having in its opposite face parallel cross grooves. The grooves have teeth projecting into the grooves from the side walls thereof, the teeth on one side being interspaced with those on the opposite side, the edges of said teeth converging downwardly whereby the teeth overlap one another in the bottom portions of the grooves.

SUMMARY OF THE INVENTION

The present invention teaches certain benefits in construction and use which give rise to the objectives described below.

The present invention provides a storage system that includes a shelf bracket that has an elongate rigid mounting structure, a top arm extending outwardly from the elongate rigid mounting structure orthogonal to the elongate rigid mounting structure, and a bottom arm extending outwardly from the elongate rigid mounting structure. A proximal end of the bottom arm is attached to the elongate rigid mounting structure, and the distal end is attached to the top arm so that the top arm and the bottom arm form an angle of between 5-60 degrees. The bottom arm is in the form of a strut channel that includes a U-shaped cross section that includes a back wall, two opposed side walls extending downwardly from the back wall, each of the opposed side walls extending to an inwardly extending portion, which extends to an edge.

A primary objective of the present invention is to provide a storage rack system having advantages not taught by the prior art.

Another objective is to provide a storage rack system that includes shelf brackets that are constructed to removably mount items and/or accessories on an angled bottom arm of the shelf bracket.

A further objective is to provide a storage rack system that is quickly and easily customizable to many different configurations for holding a wide variety of items.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a storage rack system that is adapted to be mounted on a vertical wall for storing a variety of items.

Figure 1:
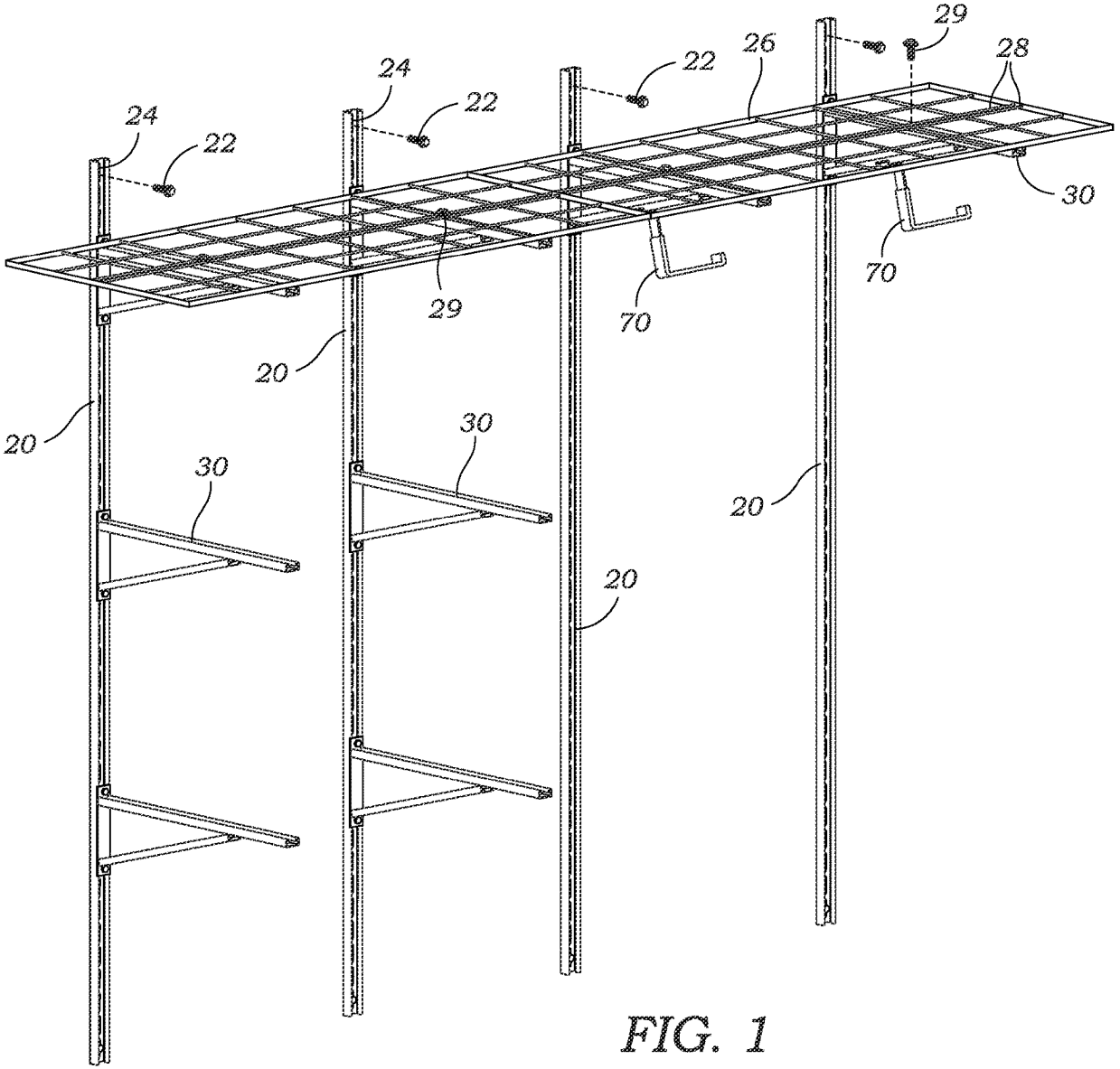
FIG. 1 is a perspective view of a storage rack system according to one embodiment of the present invention, the storage rack system having a plurality of mounting strut channels and a plurality of shelf brackets.

FIG. 1 is a perspective view of a storage rack system 10 according to one embodiment of the present invention. As shown in FIG. 1, in this embodiment the storage rack system 10 includes a plurality of mounting strut channels 20 and a plurality of shelf brackets 30, which are described in greater detail below. In this embodiment, the mounting strut channels 20 are mounted vertically on a wall (e.g., a garage wall, or any other location where a user might want to store various items, such as sporting goods, or any other items that a user might want to store).

Figure 6:
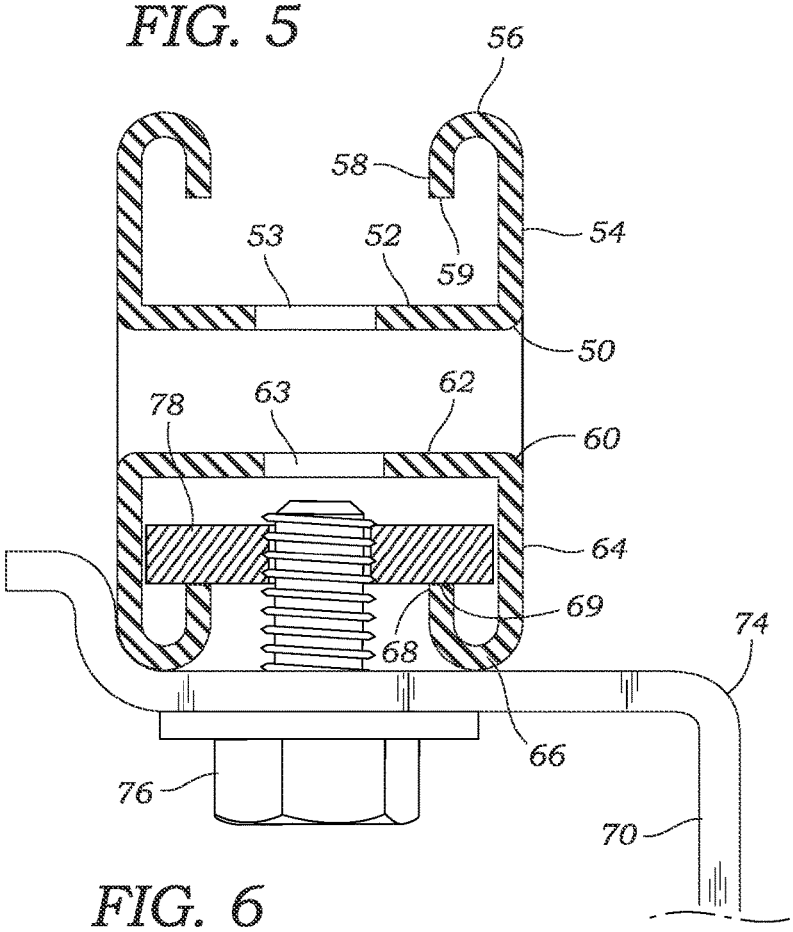
FIG. 6 is a sectional view of the shelf bracket and the hook, taken along lines 6-6 in of FIG. 4, illustrating how the hook is mounted on the shelf bracket once fully assembled.

In this embodiment, the mounting strut channels 20 are mounted to the wall using a plurality of fasteners 22, in this case screws or bolts, which are positioned through slots 24 in the mounting strut channels 20. The general construction of strut channels (in this case, slotting strut channels) are known in the prior art, they are not discussed in greater detail herein, although they are typically of the same construction as shown in FIG. 6.

As shown in FIG. 1, the shelf brackets 30 may be mounted on the mounting strut channels 20, as discussed in greater detail below. They may be adjustably mounted, so that they may be easily be moved to different positions. The shelf brackets 30 are then used to support a shelf 26, in this case a wire shelf that includes parallel wires or rods, which may be fastened to the shelf bracket 30 with a fastener 29. Obviously, a wide variety of shelves may be used (e.g., a simple wooden plank, and/or any other forms of shelves known in the art), and the shelf brackets 30 may also be used to support other structures other than shelves.

The shelf bracket 30 may be used to mount a hook 70, as discussed in greater detail below. While one embodiment of the hook 70 is illustrated, the particular shape and construction of the hook 70 may vary considerably, and alternative designs and configurations should be considered within the scope of the present invention.

Figure 2:
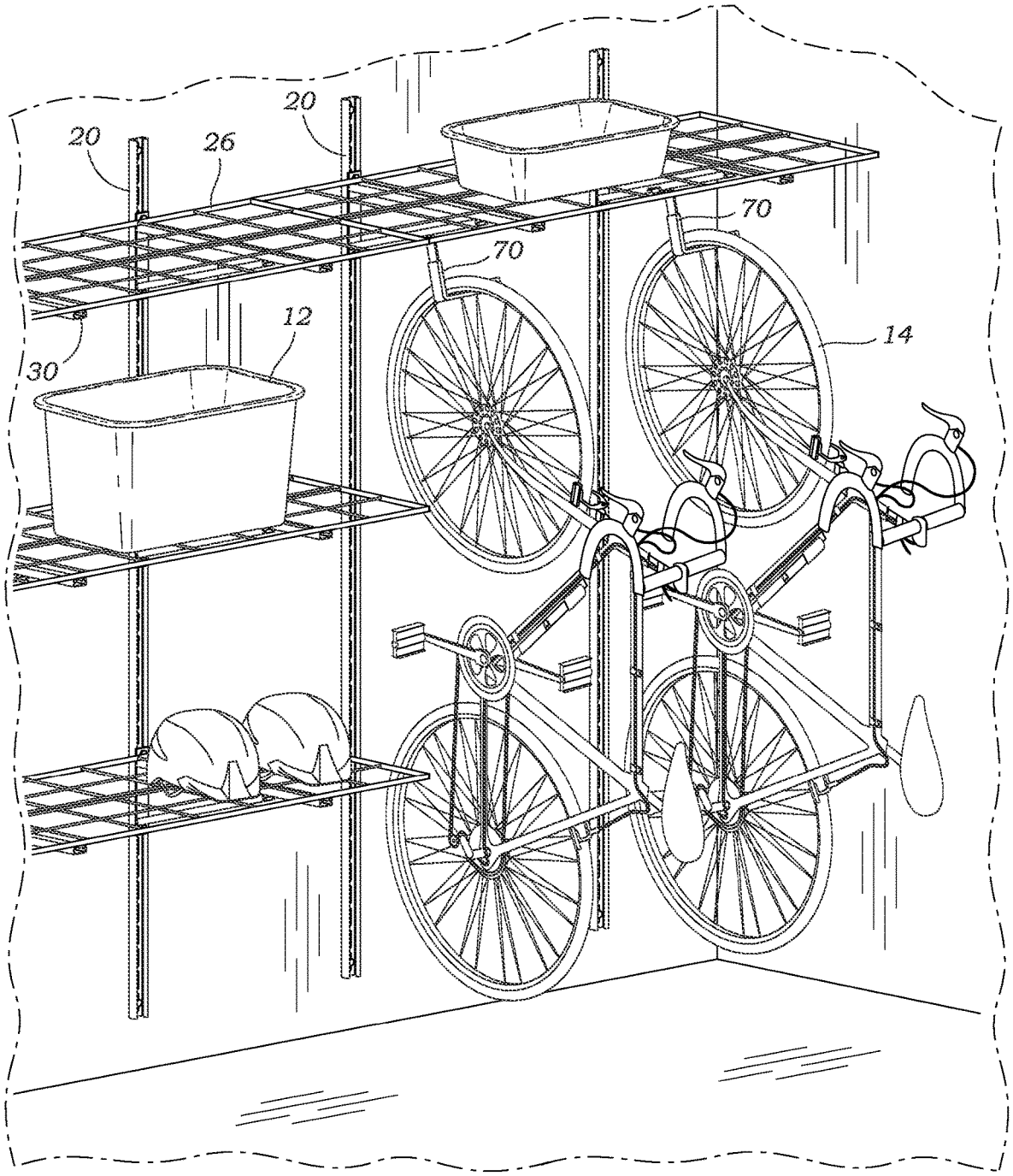
FIG. 2 is a perspective view of the storage rack system of FIG. 1 while in use.

FIG. 2 is a perspective view of the storage rack system 10 of FIG. 1 while in use. As shown in FIG. 2, the storage rack system 10 may be used to support a variety of items 12, such as storage bins, sporting equipment, holiday ornaments, and any other items a user might want to store. The hooks 70 may be used for supporting bicycles and other similar items. While one embodiment of the storage rack system 10 is illustrated, an infinite number of designs and configurations are possible, and such alternatives should be considered within the scope of the present invention.

Figure 3:
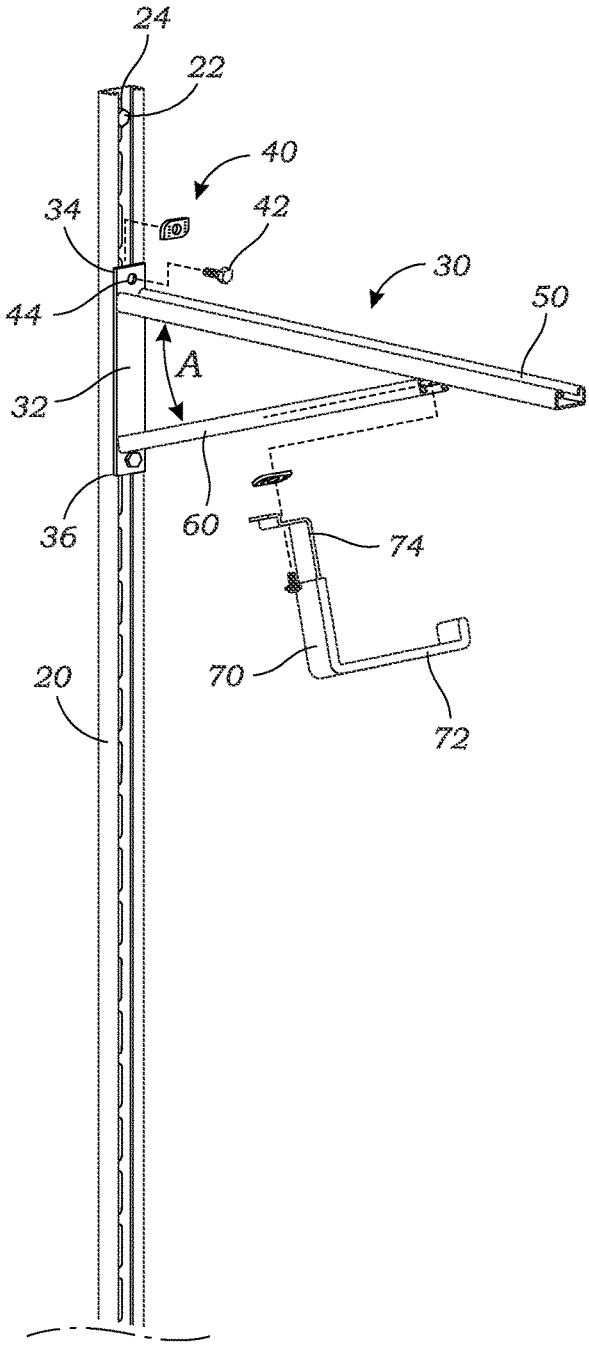
FIG. 3 is a partially exploded perspective view of one of the mounting strut channels and one of the shelf brackets, illustrating a hook mounted on the shelf bracket.
Figure 4:
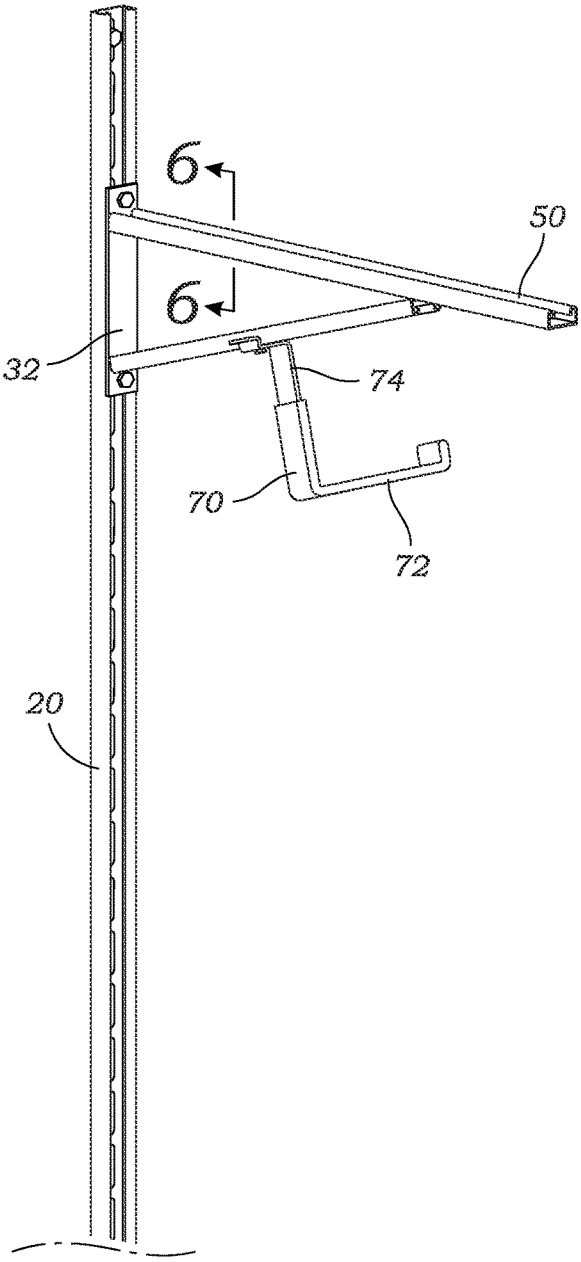
FIG. 4 is a perspective view of the vertical strut channel and the shelf bracket of FIG. 2, once the hook has been mounted on the hook.
Figure 5:
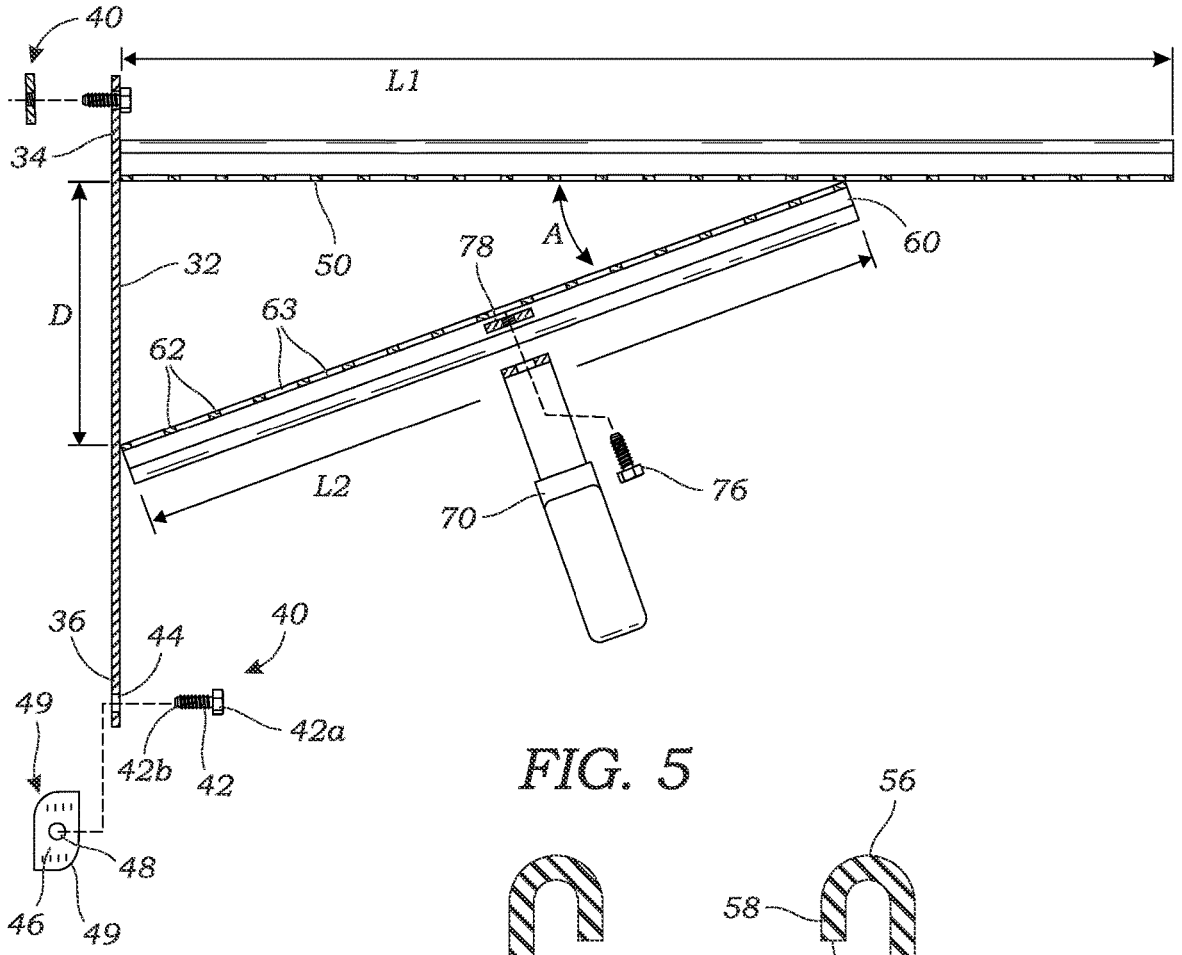
FIG. 5 is a side elevation view of the shelf bracket of FIG. 2, with a portion of the shelf bracket broken away to illustrate how the hook is mounted on the shelf bracket.

FIG. 3 is a partially exploded perspective view of one of the mounting strut channels and one of the shelf brackets 30, illustrating the hook 70 mounted on the shelf bracket 30. FIG. 4 is a perspective view of the vertical strut channel and the shelf bracket 30 of FIG. 2, once the hook 70 has been mounted on the hook 70. FIG. 5 is a side elevation view of the shelf bracket 30 of FIG. 2, with a portion of the shelf bracket 30 broken away to illustrate how the hook 70 is mounted on the shelf bracket 30. FIG. 6 is a sectional view of the shelf bracket 30 and the hook 70, taken along lines 6-6 in of FIG. 4, illustrating how the hook 70 is mounted on the shelf bracket 30 once fully assembled.

As shown in FIGS. 3-6, the shelf bracket 30 includes an elongate rigid mounting structure 32 having a top end 34 and a bottom end 36. In this embodiment, the elongate rigid mounting structure 32 is in the form of a rigid plate, rod, or similar structure (e.g., steel, rigid plastic, etc.), although it may take many forms and shapes. The elongate rigid mounting structure 32 in this embodiment is shaped to fit over and abut one of the mounting strut channels 20.

As shown in FIGS. 3-6, the shelf bracket 30 includes a means for mounting 40 the elongate rigid mounting structure 32 upon one of the mounting strut channels 20 so that the elongate rigid mounting structure 32 is disposed in a vertical orientation adjacent to the wall. In this embodiment, as shown in FIGS. 3 and 5, the means for mounting 40 includes a bolt 42 that fits through apertures 44, which in this embodiment are located adjacent the top end 34 and the bottom end 36, and engages a locking nut 46 which may have a generally rectangular body and a centrally located tapped opening 48, the locking nut being sized and shaped to fit within the U-shaped cross section of one of the mounting strut channel 20. With particular reference to FIG. 5, the bolt 42 has a head 42*a* and a shank 42*b*, the shank 42*b* being externally threaded and being sized to fit through one of the apertures 44 of the elongate rigid mounting structure 32 and threadedly engage the tapped opening 48 of the locking nut 46, for removably clamping the elongate rigid mounting structure 32 to the mounting strut channel 20.

As shown particularly in FIG. 5, the shelf bracket 30 further includes a top arm 50 extending outwardly from the elongate rigid mounting structure 32 adjacent the top end 34, and a bottom arm 60 extending outwardly from the elongate rigid mounting structure 32. In the embodiment of FIG. 5, the top arm 50 extends in a horizontal orientation orthogonal to the elongate rigid mounting structure 32. The bottom arm 60 extends from a proximal end 62 to the distal end 64, wherein the proximal end 62 is attached to the elongate rigid mounting structure 32 between the top arm 50 and the bottom end 36 of the elongate rigid mounting structure 32. In this embodiment, the top arm 50 has a length L1, and the bottom arm 60 has a length L2, with the length L1 being greater than L2. The top and bottom arms 50 and 60 are separated by a distance D at the elongate rigid mounting structure 32.

As shown in FIG. 5, the distal end 63 is attached (e.g., welded, mechanically fastened, or otherwise connected) to the top arm 50 so that the top arm 50 and the bottom arm 60 form an angle A of between 5-60 degrees. In the current embodiment, the angle A is approximately 20 degrees. The benefit of this angle A is that it allows the hook 70 or any other items to be fastened to the shelf bracket 30, beneath the shelf bracket 30, and further, the horizontal and vertical location of the hook 70 or other item (with respect to the wall, ground, or other surrounding structure) may be adjusted by moving the hook 70 or other item forward and backward on the bottom arm 60.

As shown in FIG. 6, the top arm 50 may be in the form of a strut channel that includes a U-shaped cross section that includes a back wall 52, two opposed side walls 54 extending upwardly from the back wall 52, each of the opposed side walls 54 extending to an inwardly extending portion 56, which may extend to a downwardly extending portion 58, the downwardly extending portion terminating in an edge 59. A plurality of slots disposed along the length of the back walls of each of the at least two mounting strut channels 20.

Also shown in FIG. 6, the bottom arm 60 is of similar construction, wherein the bottom arm 60 is in the form of a strut channel that includes a U-shaped cross section that includes a back wall 62, two opposed side walls 64 extending downwardly from the back wall, each of the opposed side walls 64 extending to an inwardly extending portion 66, which extends to an upwardly extending portion 68, the upwardly extending portion terminating in an edge 69. Slots 53 (any form of aperture suitable for receiving a screw, bolt, or similar fastener) may be similarly formed on the back wall 62, although this also is not required.

The hook 70 has a hook body 72 (best shown in FIG. 3, which is curved (e.g., U-shaped, C-shaped, or similarly shaped) for hooking an item, such as a bicycle 14 as shown in FIG. 2). The hook 70 also includes a mounting arm 74 extending from the hook body, the mounting arm being adapted to be mounted to the shelf bracket 30. As best shown in FIG. 6, a locking nut 78 having a generally rectangular body and a centrally located tapped opening (as described in more detail above), is sized and shaped to fit within the U-shaped cross section of the bottom arm to abut the edges. A bolt 76 having a head and a shank, the shank being externally threaded and being sized to fit through the aperture of the mounting arm of the hook and threadedly engage the tapped opening of the locking nut, for removably clamping the hook 70 against the bottom arm 60. These types of fasteners may be used to attach any item or accessory to either the top or bottom arms 60 and 70, or to any of the mounting strut channels 20, thereby giving the present invention a tremendous flexibility in configuration and design.

As shown in FIG. 5, the locking nut 46 (or 78) may include two diagonally opposite corners 49 which are removed to form rounded corners, while the other corners remain squared at 90 degrees. This configuration aids in installation of the nut 46 in the channel. Obviously, these any other details may be adjusted by one skilled in the art without departing from the present invention, and these alternative configurations should be considered within the scope of the present invention.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A shelf bracket that is adapted to be mounted on a vertical wall, the shelf bracket comprising:

an elongate rigid mounting structure having a top end and a bottom end;

a means for mounting the elongate rigid mounting structure upon the vertical wall so that the elongate rigid mounting structure is disposed in a vertical orientation that abuts or adjacent to the vertical wall;

a top arm extending outwardly from the elongate rigid mounting structure adjacent the top end, the top arm being in the form of a strut channel that includes a U-shaped cross section that includes a back wall, two opposed side walls extending upwardly from the back wall, each of the opposed side walls extending to an inwardly extending portion, which extends to a downwardly extending portion, the downwardly extending portion terminating in an edge;

wherein the top arm extends in a horizontal orientation orthogonal to the elongate rigid mounting structure;

a bottom arm extending outwardly from the elongate rigid mounting structure from a proximal end to a distal end, wherein the proximal end is attached to the elongate rigid mounting structure between the top arm and the bottom end of the elongate rigid mounting structure, and wherein the distal end is attached to the top arm so that the top arm and the bottom arm form an angle of between 5-60 degrees; and wherein the bottom arm is in the form of a strut channel that includes a U-shaped cross section that includes a bottom arm back wall, two opposed bottom arm side walls extending downwardly from the bottom arm back wall, each of the opposed bottom arm side walls extending to a bottom arm inwardly extending portion, which extends to a bottom arm upwardly extending portion, the bottom arm upwardly extending portion terminating in a bottom arm edge.

2. The shelf bracket of claim 1, further comprising:

a hook having a hook body and a mounting arm extending from the hook body, the mounting arm having an aperture therethrough;

a locking nut having a generally rectangular body and a centrally located tapped opening, the locking nut being sized and shaped to fit within the U-shaped cross section of the bottom arm to abut the bottom arm edges;

a bolt having a head and a shank, the shank being externally threaded and being sized to fit through the aperture of the mounting arm of the hook and threadedly engage the tapped opening of the locking nut, for removably clamping the hook against the bottom arm.

3. The shelf bracket of claim 2, wherein the locking nut includes two diagonally opposite corners that defines rounded corners.

4. The shelf bracket of claim 2, further comprising:

at least two mounting strut channels, each having a U-shaped cross section that includes a mounting strut channel back wall, two opposed mounting strut channel side walls extending upwardly from the mounting strut channel back wall, each of the opposed mounting strut channel side walls extending to a mounting strut channel inwardly extending portion, which extends to a mounting strut channel downwardly extending portion, the mounting strut channel downwardly extending portion terminating in a mounting strut channel edge;

a plurality of slots disposed along the length of the mounting strut channel back walls of each of the at least two mounting strut channels; and wherein the means for mounting the elongate rigid mounting structure includes a pair of bolts that each extend through an aperture in the elongate rigid mounting structure, and through one of the at least two mounting strut channels.

* * * * *